US010111543B2

(12) United States Patent
Terragni et al.

(10) Patent No.: US 10,111,543 B2
(45) Date of Patent: Oct. 30, 2018

(54) VERTICAL-SLIDE CLOTHES-HANGING DEVICE

(71) Applicant: SERVETTO S.R.L., Bovisio Masciago (IT)

(72) Inventors: Ezio Terragni, Lentante Sul Seveso (IT); Emilio Terragni, Lissone (IT); Carlotta Terragni, Lentate Sul Seveso (IT)

(73) Assignee: SERVETTO S.R.L., Bovisio Masciago (IT)

( * ) Notice: Subject to any disclaimer, the term of this patent is extended or adjusted under 35 U.S.C. 154(b) by 0 days.

(21) Appl. No.: 15/741,056

(22) PCT Filed: Jul. 22, 2016

(86) PCT No.: PCT/EP2016/067499

§ 371 (c)(1),
(2) Date: Dec. 29, 2017

(87) PCT Pub. No.: WO2017/017001

PCT Pub. Date: Feb. 2, 2017

(65) Prior Publication Data

US 2018/0192805 A1 Jul. 12, 2018

(30) Foreign Application Priority Data

Jul. 30, 2015 (IT) ..... 102015000040412

(51) Int. Cl.
*A47G 25/06* (2006.01)
*A47B 61/02* (2006.01)

(52) U.S. Cl.
CPC ..... *A47G 25/0685* (2013.01); *A47B 61/02* (2013.01)

(58) Field of Classification Search
CPC ..... A47B 46/005; A47B 46/00; A47B 61/02; A47B 61/003; A47B 77/10; B62H 3/12;
(Continued)

(56) References Cited

U.S. PATENT DOCUMENTS 1,466,859 A * 9/1923 Sutton ..... A47B 61/003 211/99
1,799,521 A * 4/1931 Levine ..... A47B 61/02 190/13 C (Continued)

FOREIGN PATENT DOCUMENTS

GB 220136 A 1/1990
JP H02111314 A 4/1990

*Primary Examiner* — Patrick D Hawn
(74) *Attorney, Agent, or Firm* — Flener IP & Business Law; Zareefa B. Flener

(57) ABSTRACT

The present invention relates to a vertical-slide clothes-hanging device comprising a horizontal rod for receiving hanging clothes coupled with at least one activation element. The activation element comprises a lever with a first free end coupled with the horizontal rod and a maneuvering kinematic mechanism coupled with a second end of the lever. The maneuvering kinematic mechanism comprises an actuator and articulation element acted on by the second end of the lever. The maneuvering kinematic mechanism moves the lever between two terminal run-end positions, a first raised position substantially vertical, or almost vertical, and a second lowered position substantially horizontal. Run-end dampers are provided in the two terminal positions, suitable for damping a terminal run section of the lever. When the lever is close to the lowered position, a first damper is coupled with the lever to exert a first braking action.

5 Claims, 6 Drawing Sheets

(58) Field of Classification Search
CPC .... A47F 5/0087; A47G 25/0685; A47G 25/02
See application file for complete search history.

(56) References Cited

U.S. PATENT DOCUMENTS 2,550,158 A * 4/1951 McCormick ..... D06F 57/12 211/1.3
2,597,115 A * 5/1952 Lundstrum ..... D06F 58/14 211/100
2,851,165 A * 9/1958 Schreyer ..... A47F 7/24 211/1.51
2,875,903 A * 3/1959 Shourds ..... A47B 61/02 211/100
3,976,200 A * 8/1976 Munns ..... B62H 3/12 211/100
4,006,826 A * 2/1977 Rich ..... A47F 5/0087 211/101
4,114,764 A * 9/1978 Rich ..... A47F 5/0087 211/100
4,323,162 A * 4/1982 Steinhilber ..... A47G 25/0685 211/100
5,011,029 A * 4/1991 Sugasawara ..... A47B 61/003 16/54
5,224,677 A * 7/1993 Close ..... A47F 5/0087 211/104
5,228,763 A * 7/1993 Gingold ..... A47B 46/005 312/247
5,308,158 A * 5/1994 Vogelgesang ..... A47B 77/10 211/170
5,439,121 A * 8/1995 Agostoni ..... A47B 61/003 211/100
5,462,347 A * 10/1995 Vogelgesang ..... A47B 46/005 312/247
5,560,501 A * 10/1996 Rupert ..... A47B 46/00 211/104
5,695,072 A * 12/1997 Terragni ..... A47G 25/02 211/1.51
5,758,782 A * 6/1998 Rupert ..... A47B 46/00 211/104
6,082,552 A * 7/2000 Pollock ..... B62H 3/12 211/104
6,105,795 A * 8/2000 Terragni ..... A47G 25/02 211/100
6,269,958 B1 * 8/2001 Pollock ..... B62H 3/12 211/104
6,378,818 B1 * 4/2002 Padiak ..... G09F 7/22 248/201
6,691,878 B1 * 2/2004 Ouitz ..... A47B 97/00 211/103
7,874,437 B2 * 1/2011 Jones ..... A47B 61/003 211/105.1
7,922,268 B2 * 4/2011 Weber ..... A47B 51/00 312/246
8,061,789 B2 * 11/2011 Krueger ..... A47B 61/00 211/100
9,055,813 B2 * 6/2015 Telthorster ..... A47B 46/005
2006/0108303 A1 5/2006 Rupert

* cited by examiner 41
4
62
71
61

52
6
61
51
62
V
V
V

VERTICAL-SLIDE CLOTHES-HANGING DEVICE

CROSS-REFERENCE TO RELATED APPLICATIONS

This application is a National Phase application of International Application No. PCT/EP2016/067499, filed on Jul. 22, 2016, which in turn claims priority to Italy Application No. 102015000040412, filed on Jul. 30, 2015.

BACKGROUND OF THE INVENTION

The present invention relates to an improved vertical-slide clothes-hanging device.

Vertical-slide clothes-hanging devices are known in the art, which comprise a horizontal clothes-hanger rod (designed for receiving hanging clothes) coupled with one or two side bearing levers, each extending from a suitable kinematic mechanism contained inside a shell fixed to the shoulder of a piece of furniture or to side walls of a wall compartment, or other bearing surface.

This creates an extremely useful vertical-sliding mechanism which, when assembled in the upper part of a wardrobe, for example, carries the clothes downwards and vice-versa.

In a known manual version, said vertical-sliding clothes-hanging device also comprises a handle or grip constrained to the clothes-hanging rod, whereby the user can manoeuvre the clothes-hanging device both downwards and upwards.

Gentle movements are ensured by balancing means cooperating with said manoeuvring kinematic mechanisms of the levers.

In a known electronic version, the mechanism is provided with an electric gearmotor which, automatically controlled through a remote-control unit, allows the upward and downward movement of the clothes-hanger rod.

The above-mentioned mechanism is described, for example, in European patent EP0741986 of the same Applicant.

The downward rotation movement (descent of the clothes-hanger rod) and upward rotation movement (ascent of the clothes-hanger rod) must be efficient both when the rod is fully loaded and also when it is almost unloaded.

As the most burdensome functioning condition is obtained when the rod is fully loaded, the sizing of the kinematic mechanisms is consequently often effected under this condition of maximum load allowable.

This often implies, however, that in an intermediate loaded or overloaded condition, the functioning is not completely regular, and the clothes-hanger rod reaches the run-end positions rather abruptly (i.e. with a significant angular velocity), bumping against the run-ends.

The objective of the present invention is to provide a clothes-hanging device of the type mentioned above, capable of functioning optimally regardless of the load conditions, with fluid functioning and without any bumps at the run-ends, that is relatively economical, easy to install and sturdy.

This objective has been reached by a vertical-slide clothes-hanging device of the type indicated in the first claim.

BRIEF SUMMARY OF THE INVENTION

The idea at the basis of the present invention is to provide a vertical-slide clothes-hanging device comprising: a horizontal rod destined for receiving hanging clothes, said rod being coupled with at least one activation element which comprises a lever having a first free end coupled with said horizontal rod a kinematic manoeuvring mechanism at least partially supported by and contained in a shell that can be fixed on a bearing surface, said kinematic manoeuvring mechanism being coupled with a second end of said lever, the lever being movable by the kinematic manoeuvring mechanism between two run-end positions, a first raised position, substantially vertical or almost vertical, and a second lowered position, substantially horizontal, wherein corresponding run-end dampers suitable for dampening a final run portion of the lever, are provided in said two end-positions.

This prevents the lever from colliding against the shell, once the end-positions of the run-end have been reached, generating not only a potential breakage of the shell but also noise and a sense of low-quality.

The device of the invention also has a more silent functioning with respect to the devices of the known art, as it avoids the sound of the impact of the lever when it reaches the end positions.

The structural and functional characteristics of the invention and its advantages with respect to the known art will be more evident from the following description, referring to the enclosed drawings that show practical embodiments examples of the invention itself. In the drawings:

DETAILED DESCRIPTION OF THE DRAWINGS

Figure 2:
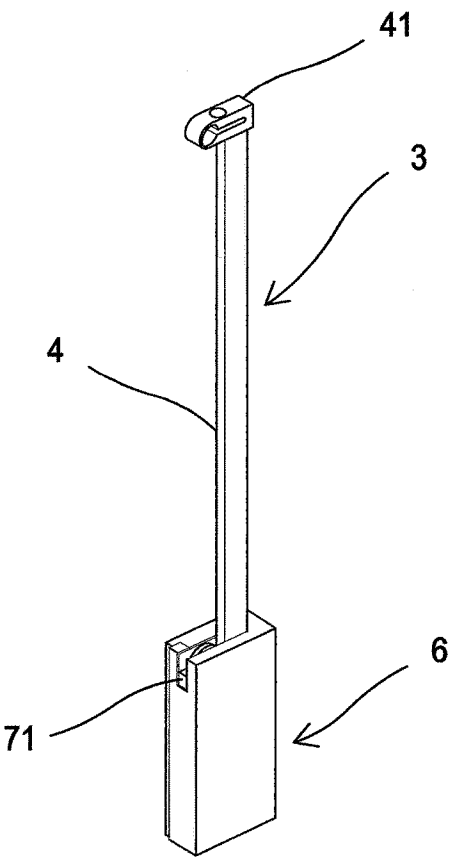
FIG. 2 shows a perspective view of an activation element of the clothes-hanging device of the previous figure.
Figure 1:
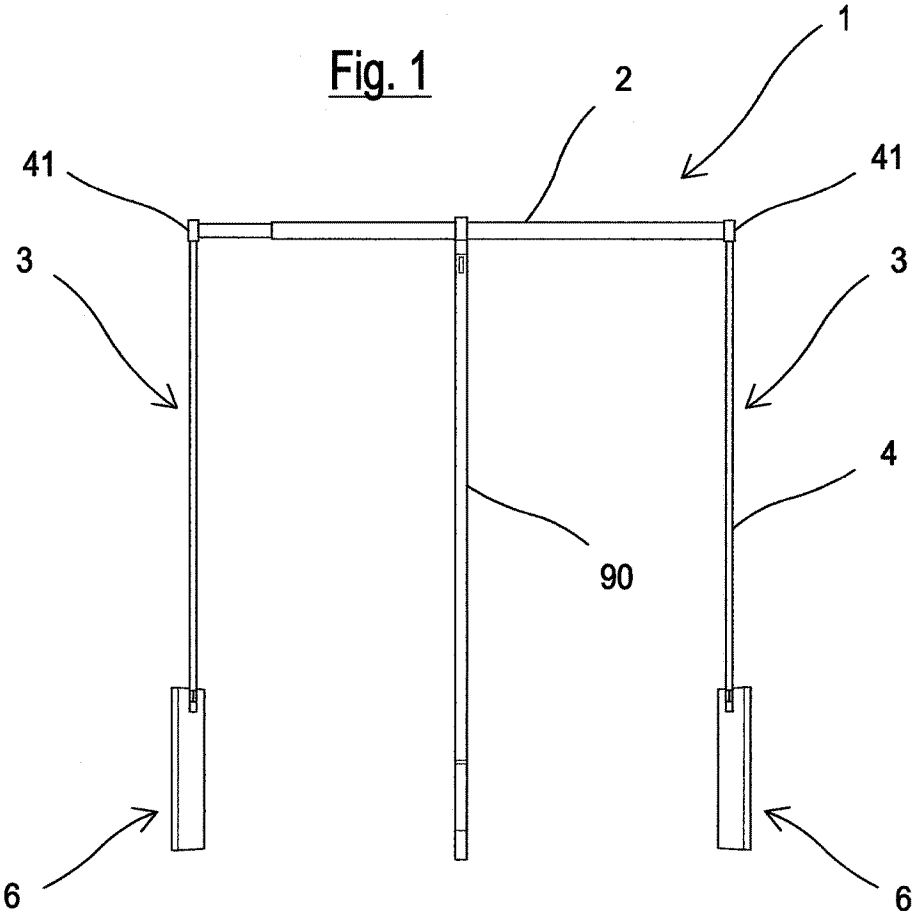
FIG. 1 shows a front view of an example of a vertical-slide clothes-hanging device according to the invention.
Figure 4:
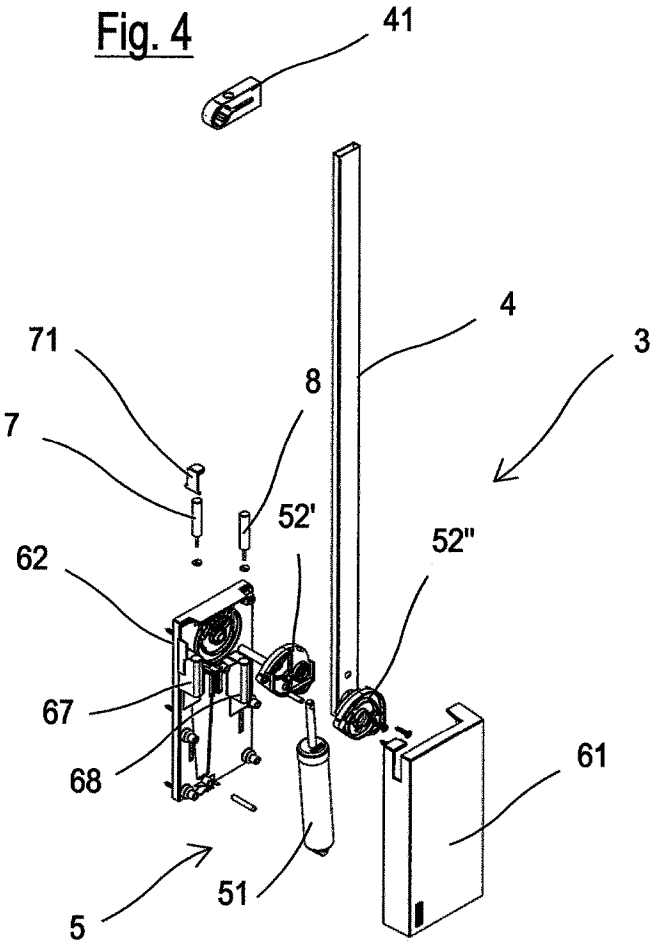
FIGS. 3 and 4 show two exploded views according to different perspectives of the activation element of the previous figure.
Figure 3:
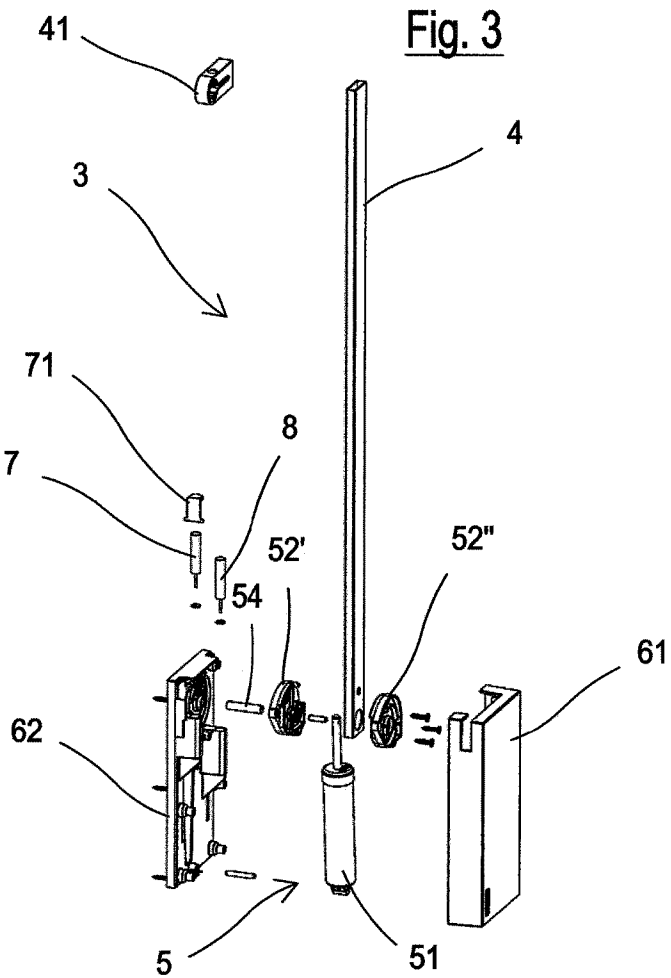

The enclosed FIG. 1 shows a vertical-slide clothes-hanging device 1 of the invention, in a first embodiment.

In this first embodiment, the clothes-hanging device 1 comprises a horizontal rod 2 destined for receiving hanging clothes; the rod 2 is coupled, at opposite free ends, with two activation elements 3, destined for being fixed to bearing surfaces, such as, for example, shoulders of a wardrobe or vertical walls of a walk-in closet or the like.

In the case of a manually activated device 1, a maneuvering arm 90, that can be adopted by the user for lifting/lowering the rod 2, is connected to the horizontal rod 2, free to rotate with respect to the rod. The rod 90 is obtained by the injection moulding of plastic material in a single piece, the form and material have been specifically studied for conferring elasticity, robustness and easy use.

It should be noted that, in the present description and following claims, references to "horizontal" and "vertical" positions and the like, should be considered as being in an operational, installed condition of the device 1.

It should also be noted that, even if there are two activation elements 3 in the configuration of the device 1 illustrated, said device may also be provided with only one activation element, for example in a central or intermediate position of the horizontal rod 2.

With respect to the activation element 3 shown in FIGS. 2-12 according to various views, this comprises a lever 4 having a first free end variably coupled with the horizontal rod 2.

In the preferred embodiment, the coupling between the lever 4 and the rod 2 is obtained by means of the fixing bracket 41, which has a deformable seat having a complementary form with respect to the form of the rod, provided with a slot, so that, when engaged, the rod can be blocked to the bracket (for example by means of a threaded bead, a screw or the like), deforming the seat.

The rod 2 preferably has a circular section, the rod 4 has a rectangular section and the bracket 41 is made of die-cast aluminium.

Again with respect to the activation element 3, the same comprises a manoeuvring kinematic mechanism 5 at least partially supported by and contained in a shell 6.

The latter can be fixed in various ways to the above-mentioned bearing surface, for example coupled by means of a guide/slide mechanism (not shown).

Figure 5:
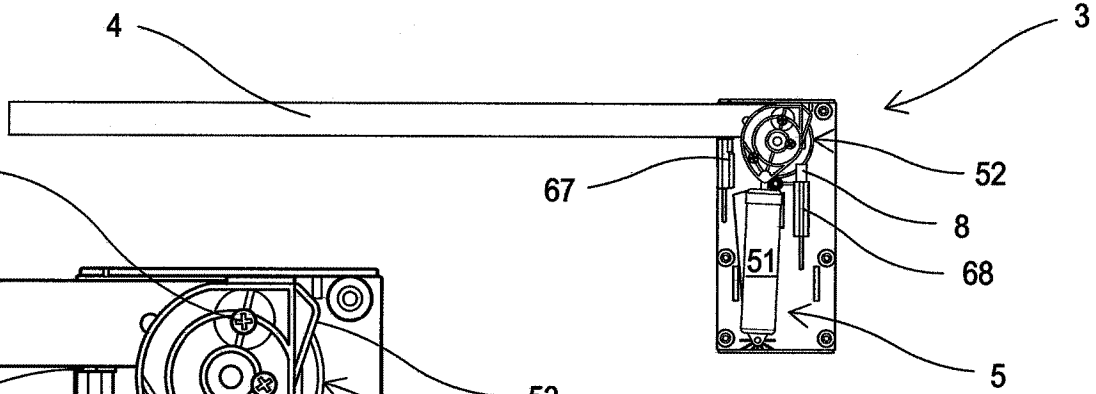
FIGS. 5 and 6 show a sectional side view and an enlargement of the activation element of FIGS. 2-4 in a first position.
Figure 6:
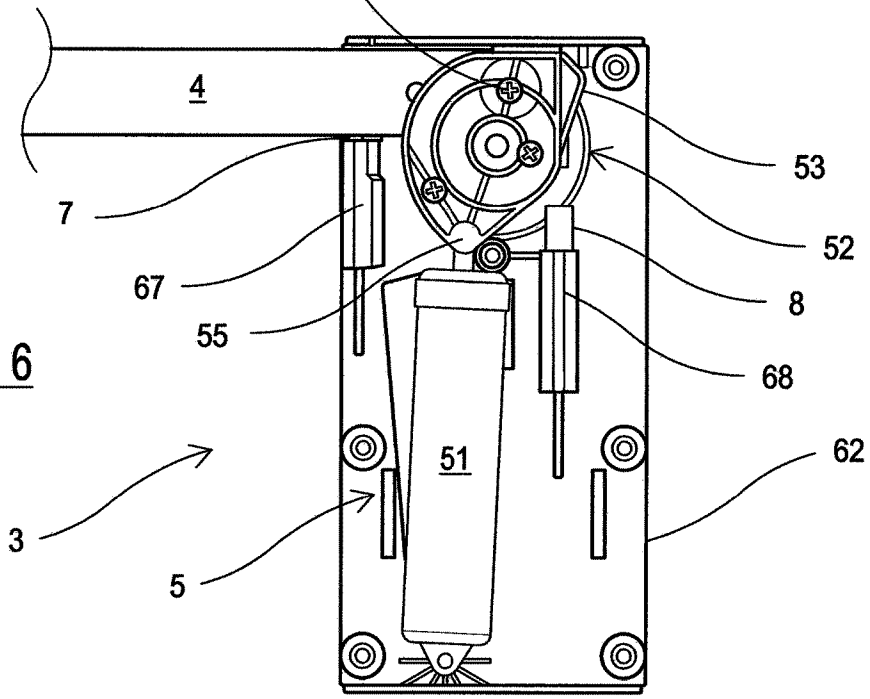
Figure 8:
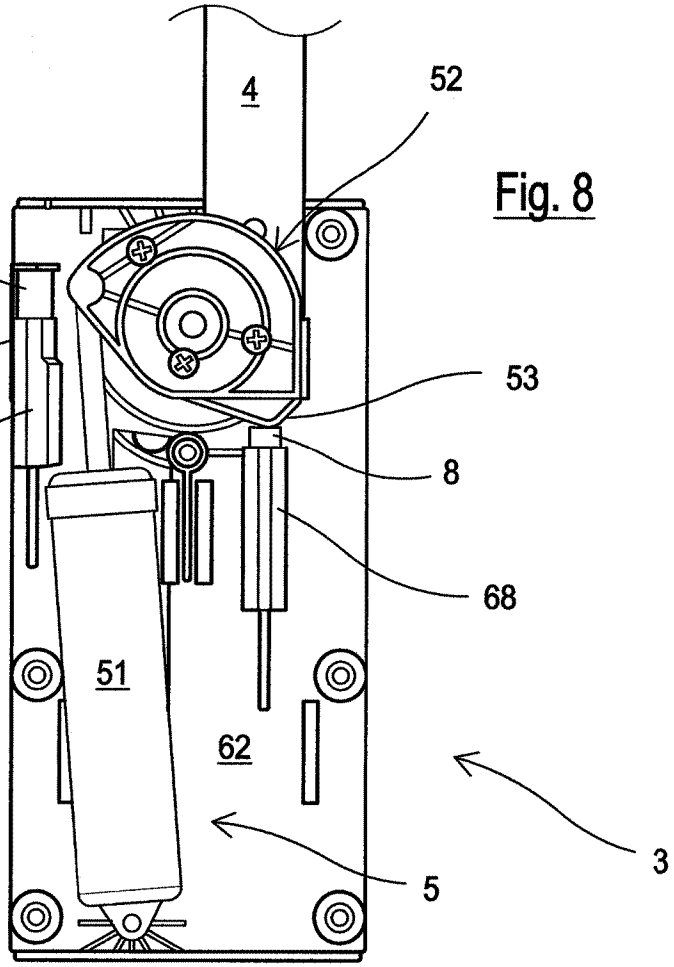
FIGS. 7 and 8 show a sectional side view and an enlargement of the activation element of FIGS. 2-4 in a second position.
Figure 7:
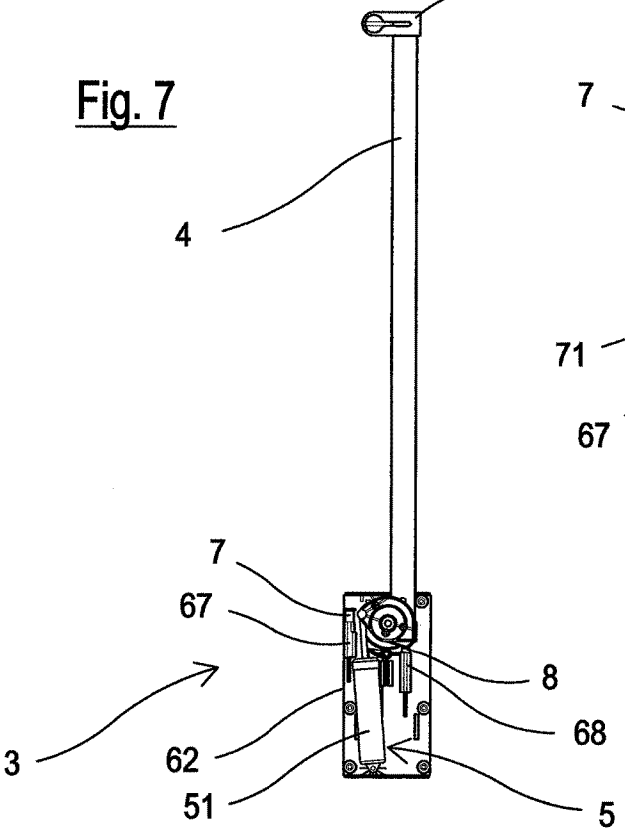
Figure 10:
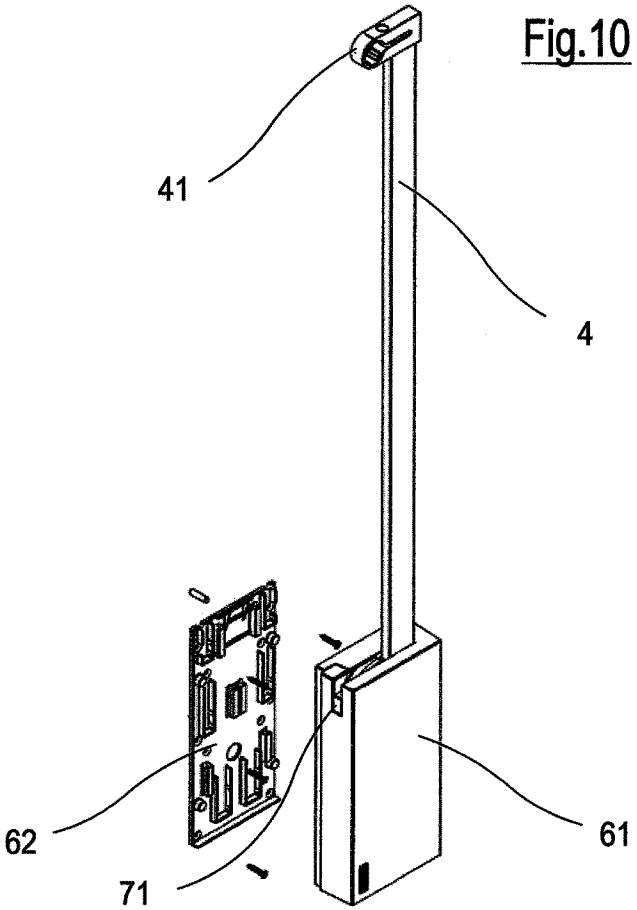
FIG. 10 shows a different partially exploded view of the activation element.
Figure 9:
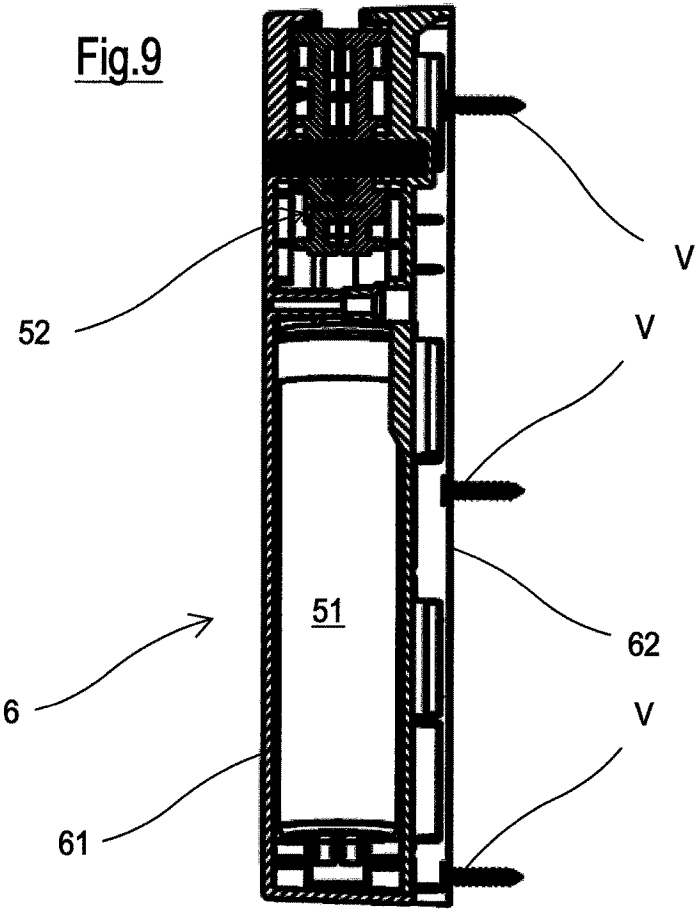
FIG. 9 shows a sectional transversal view of the activation mechanism.

The manoeuvring kinematic mechanism 5 is coupled to a second end of said lever 4, so that the latter can be moved with the aid of the manoeuvring kinematic mechanism 5 between two terminal run-end positions:

- a first raised position, substantially vertical or almost vertical, shown, for example, in FIGS. 7, 8,
- and a second lowered position, substantially horizontal, shown, for example, in FIGS. 5 and 6.

The movement between the two positions is effected with the aid of the manoeuvring kinematic mechanism 5, in the sense that the latter acts on the lever 4 to assist the user in moving the rod 2 between the two positions (lowered and raised).

For this purpose, in some embodiments, the manoeuvring kinematic mechanism 5 comprises an actuator, such as a thrust piston 51 which acts on the lever 4: the thrust piston 51 in this case comprises a cylinder and a stem sliding in the cylinder, activated by a spring and dampened by means of a fluid, for example, oil, or a gas.

No further mention will be made to the thrust piston 51 as it is not a specific object of the present invention and, more generically, known to skilled persons in the field, who can select the type of piston 51 which is most suitable for the installation chosen; it is sufficient to note that the spring of the piston typically acts during the re-ascent of the rod 2, when the user needs help, whereas the fluid (or gas) mainly acts during the descending phase of the rod 2, to slow down the movement or when unloaded.

As mentioned above, the type of piston 51 and its characteristics make it implicitly optimally dimensioned for a certain project load of clothes weighing on the rod 2: if the actual load is less than the project load, the spring of the piston 51 tends to cause the rod 2 to ascend too rapidly, whereas, if the actual load is heavier than the project load, the braking action may be insufficient, causing an excessively rapid descending rate.

In both cases, the drawbacks of the known art discussed above will arise, and are avoided, according to the disclosures of the invention, thanks to the provision, in correspondence with the two terminal run positions of the rod 4, of run-end dampers 7 and 8 suitable for dampening a final run of the lever 4.

The dampers 7 and 8 are preferably cylinders dampened with sliding piston.

In this way, in fact, whether the actual load of clothes on the rod 2 be lesser or greater than the project load of the piston 51, the run-end dampers 7 and 8 prevent the lever 4 from bumping against fixed surfaces, dampening the stoppage of the lever itself, reducing noises, wear and possible damage.

More specifically, both the first 7 and the second damper act on the lever 4: the first damper 7 preferably acts directly on the lever 4, whereas the second damper 8 acts indirectly on the lever 4, as described in detail hereunder.

As can be seen from the figures, the first damper 7 is coupled with the shell 6 and protrudes in the direction of the lever 4: when the lever 4 is close to the lowered position, the damper 7 is coupled with the lever 4 itself, so as to exert its braking action.

It should be noted that the shell 6 comprises a body part 61 and a cover part 62 destined for closing the body 61 to define a substantially closed inner volume in which the kinematic mechanism 5 is housed and preferably both of the dampers 7 and 8.

For this purpose, the body 61 is provided with housing seats 67, 68 each destined for coupling a damper 7 or 8 to the shell 6, inside the volume of the same.

Optionally, the first damper 7 is advantageously coupled with a shutter element 71.

Said shutter element 71 follows the movement of the piston of the damper 7, sliding with respect to the shell 6, for example on sliding guides (not shown), preferably present on the body 61.

The shutter element 71 is preferably L-shaped, with one wall which, when assembled, is parallel to that of the body 61 and the other positioned perpendicular to the first wall, so that when the lever 4 is abutted against the damper 7 (therefore in a lowered condition) the shutter element 71 is interposed between the lever 4 and the damper 7, reducing damage and absorbing the impact force.

This therefore allows the damper 7 to be protected.

With respect to the manoeuvring kinematic mechanism 5, in the preferred embodiment illustrated, this comprises the actuator 51 and an articulation element 52 interposed between the second end of the lever 4 and the actuator 51.

The damper 8 is coupled with the shell 6, so as to be in contact with the articulation element 52, when the lever is close to the raised position, and thus act indirectly on said lever 4.

The articulation element 52 is a substantially disc-shaped body provided with at least one cam 53 destined for cooperating with the second damper 8, as shown in the enclosed figures.

In these, it can also be noted that in the non-limiting embodiment illustrated, the articulation element 52 is composed of two coupled half-discs 52' and 52" forming the above disc-shaped body.

More specifically, the articulation element 52 comprises a rotation pin 54 coupled with the shell 6, a first connection 55, eccentric with respect to the pin 54, for coupling with the actuator 51, a second connection 56, eccentric with respect to the pin 54 for coupling with the lever 4.

The cam 53 is positioned on the side of the second connection 56 with respect to the pin 54, the first connection 55 being on the opposite side with respect to the pin 54.

Fixing means of the shell to the bearing surfaces, such as screws V, are preferably associated with the side of the cover 62 of the shell 6.

Figure 12:
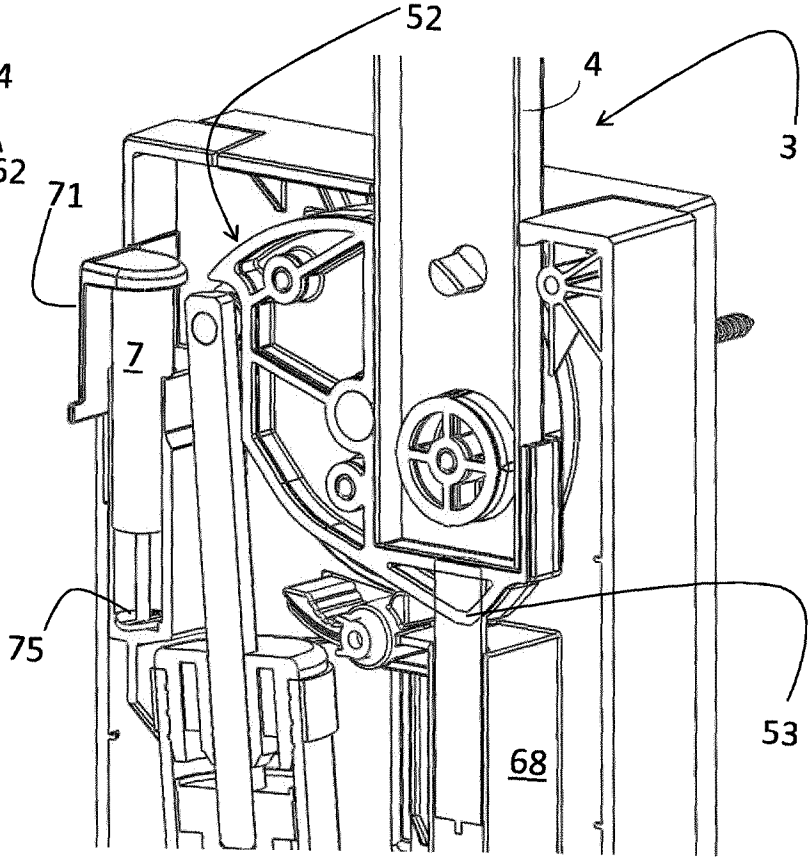
FIGS. 11 and 12 show two perspective views of details of the activation element.
Figure 11:
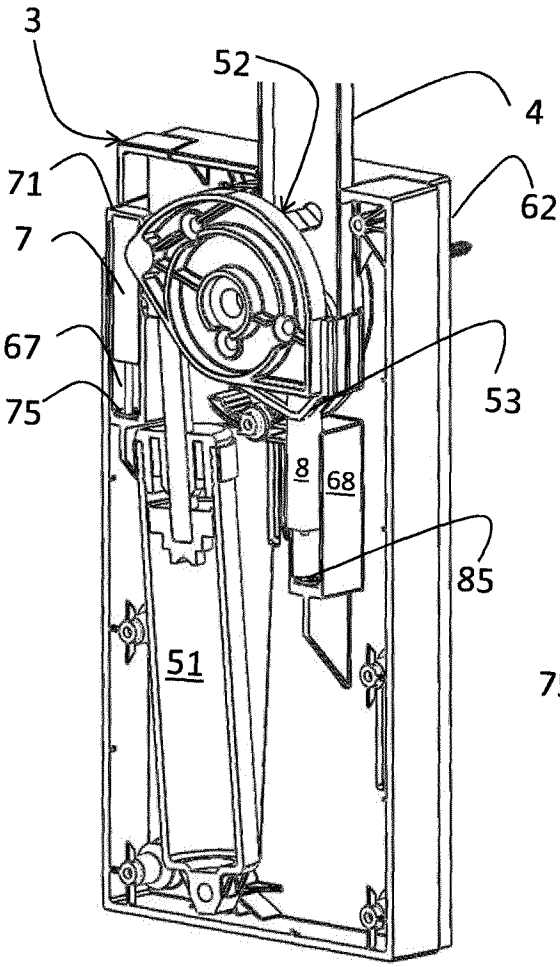

Again with respect to the dampers 7 and 8, in FIGS. 11 and 12, a steel disc 75, 85 can be observed for each seat 67, 68, on which the damper discharges the force, without damaging the seat itself.

For this purpose, it can be noted that the shell 6 is preferably made of plastic, in one piece with the seats 67, 68 which are shaped like cylinders closed by a base, in which the dampers 7,8 are inserted with the interpositioning of said discs 75,85.

The objectives mentioned in the preamble of the description have therefore been achieved.

The protection scope of the invention is defined by the following claims.

The invention claimed is:

1. A vertical-slide clothes-hanging device (1) comprising: a horizontal rod (2) destined for receiving hanging clothes, said rod (2) being coupled with at least one activation element (3), said activation element (3) comprising:

a lever (4) provided with a first free end, coupled with said horizontal rod (2), a maneuvering kinematic mechanism (5) at least partially supported and contained in a shell (6) fixable on a bearing surface, said maneuvering kinematic mechanism (5) being coupled with a second end of said lever (4), said at least one lever (4) being movable by said maneuvering kinematic mechanism (5) between two terminal run-end positions, a first raised position substantially vertical, and a second lowered position substantially horizontal, characterized in that corresponding run-end dampers (7, 8) are provided in said terminal positions, suitable for damping a terminal run section of the lever (4)

said dampers (7, 8) being dampened cylinders with a sliding piston contained in the shell (6) and coupled with the same, wherein, when the lever (4) is proximate to the lowered position, a first of said dampers (7) is coupled with the lever (4) to exert a first braking action, and wherein the maneuvering kinematic mechanism (5) comprises an actuator (51) and an articulation element (52) interposed between said second end of said lever (4) and said actuator (51), said second damper (8) being coupled with said shell (6) and configured for acting on said articulation element (52).

2. The device (1) of claim 1 wherein the shell (6) comprises a body part (61) and a cover part (62) configured for closing said body (61), to define a substantially closed inner volume, said body (61) being provided with at least housing seats (67, 68) each configured for coupling a damper (7, 8) with said shell (6) inside said volume.

3. The device (1) of claim 1 wherein said first damper (7) is coupled with a shutter element (71) sliding on said shell (6), preferably on said body (61).

4. The device (1) of claim 1 wherein the articulation element (52) is a substantially disc-shaped body provided with at least one cam (53) configured for cooperating with the second damper (8).

5. The device (1) of claim 1 wherein the articulation element (52) comprises a rotation pin (54) fixed to said shell (6), a first connection (55), eccentric with respect to the pin (54) for coupling with said actuator (51), a second connection (56), eccentric with respect to the pin (54) for coupling with the lever (4), said cam (53) being positioned on the side of the second connection (56) with respect to the pin (54).

* * * * *